US006740012B1

(12) United States Patent
Olszewski

(10) Patent No.: US 6,740,012 B1
(45) Date of Patent: May 25, 2004

(54) PRACTICE DEVICE FOR ENHANCING STRIKE ABILITY OF A BOXER

(76) Inventor: Jaroslaw Olszewski, 8000 Shore Front Pkwy., Apt. 1A, Rockaway, NY (US) 11693

( * ) Notice: Subject to any disclaimer, the term of this patent is extended or adjusted under 35 U.S.C. 154(b) by 131 days.

(21) Appl. No.: 10/166,483

(22) Filed: Jun. 10, 2002

(51) Int. Cl.[7] ..... A63B 69/00
(52) U.S. Cl. ..... 482/83; 482/87; 482/90
(58) Field of Search ..... 473/430, 423; 482/83–90

(56) References Cited

U.S. PATENT DOCUMENTS

| | | | | |
|---|---|---|---|---|
| 689,344 | A | * | 12/1901 | Yoerger |
| 3,023,001 | A | * | 2/1962 | Gourouze |
| 3,366,383 | A | * | 1/1968 | Lentine |
| 3,593,998 | A | | 7/1971 | Pattyn |
| 3,785,643 | A | | 1/1974 | Rich |
| 3,861,679 | A | | 1/1975 | Culpepper |
| 3,934,878 | A | | 1/1976 | Haber |
| 3,994,494 | A | | 11/1976 | Kelley |
| 5,098,094 | A | * | 3/1992 | Kita ..... 273/29 |
| 5,681,168 | A | | 10/1997 | Brown |
| 5,779,568 | A | * | 7/1998 | Turner et al. ..... 473/23 |
| 6,494,820 | B2 | * | 12/2002 | Orlando ..... 482/48 |

* cited by examiner

*Primary Examiner*—Jerome W. Donnelly
(74) *Attorney, Agent, or Firm*—Richard L. Miller

(57) ABSTRACT

A practice device for enhancing strike ability of a boxer that includes a support, a tethered ball suspended from the support, and a deflector operatively connected to the support. The support includes a rigid sheet of material and four flexible lengths of cord nonrestrainingly suspending the sheet of material horizontally from an overhead. The tethered ball is suspended from the sheet of material. The deflector is disposed on one edge of the sheet of material and is wedge-shaped so as to allow the ball to deflect thereoff in a random pattern when stroked by the boxer. The deflector is a equilaterally-triangular-shaped sheet bent acutely, along its altitude, into a pair of panels. Each panel has a slot slid onto one edge of the sheet of material, with the apex of the sheet facing the center of the sheet of material.

7 Claims, 1 Drawing Sheet

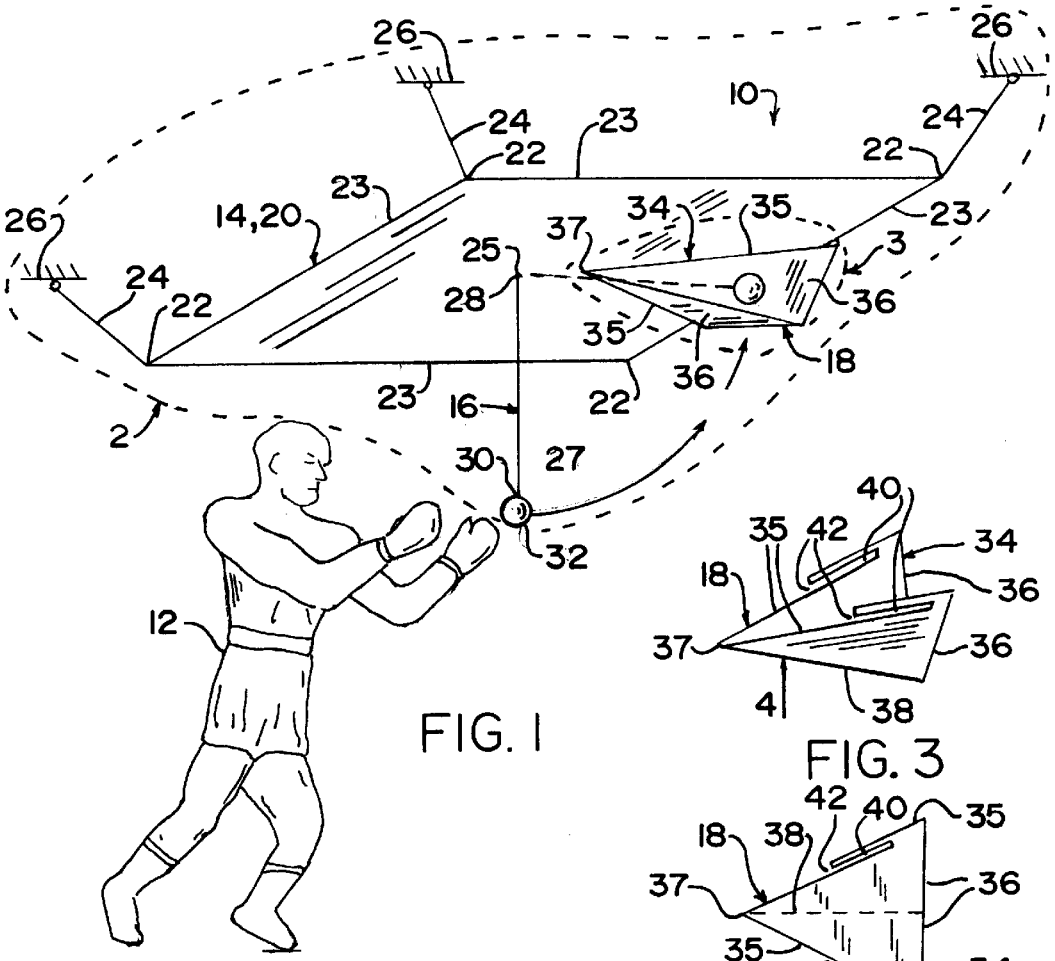
FIG. 1
FIG. 3
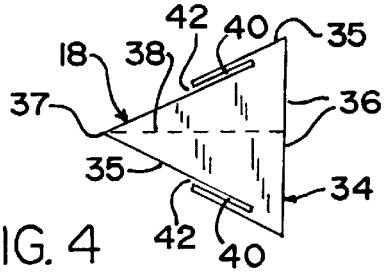
FIG. 4
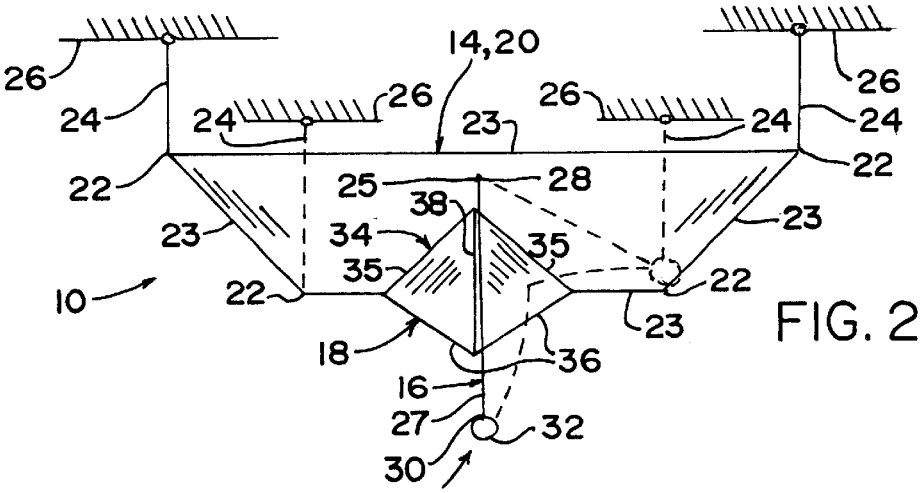
FIG. 2

PRACTICE DEVICE FOR ENHANCING STRIKE ABILITY OF A BOXER

BACKGROUND OF THE INVENTION

1. Field of the Invention

The present invention relates to a practicing device. More particularly, the present invention relates to a practice device for enhancing strike ability of a boxer.

2. Description of the Prior Art

Numerous innovations for practice devices have been provided in the prior art that will be described. Even though these innovations may be suitable for the specific individual purposes to which they address, however, they differ from the present invention.

A FIRST EXAMPLE, U.S. Pat. No. 3,593,998 to Pattyn teaches an indoor tennis practice apparatus including a hollow unpressurized ball hung on an inelastic tether from an overhead support to be stroked toward an energy-absorbing target including a pliable, fabric rectangle having two opposite edges freely suspended from the overhead support along spaced parallel lines to form a draped catenary surface. Both the horizontal spacing between the suspended edges of the fabric rectangle and the horizontal spacing between the target and the ball are adjustable to vary the character of the rebound after the ball is struck. The support can take the form of a single or double target stand or a simple beam structure for home installation.

A SECOND EXAMPLE, U.S. Pat. No. 3,785,643 to Rich teaches a tethered ball toy wherein several balls are suspended from a line, at least one of the balls being partially filled with a liquid or solid, or being mounted off-center or attached by a short cord to the line such that when one ball is struck it produces erratic movement of the other ball or balls. The suspending line may contain a resilient spring or a shock cored portion, whereby the erratic movement of the balls is further enhanced thus requiring a high degree of agility and coordination to kick, or otherwise strike, the ball several times.

A THIRD EXAMPLE, U.S. Pat. No. 3,861,679 to Culpepper teaches a game apparatus particularly adaptable for use in practicing and learning the fundamentals of the game of tennis that includes a ball, e.g., a tennis ball, suspended from a cord. The cord is connected at one end of a rigid rod having springs selectively coupled to the other end, and a stabilizing member is coupled to and spaced from the ends of the rod. The rod and stabilizing member are rotatably coupled to a supporting structure. In use, when the suspended ball is struck with a blow, e.g., with a tennis racket, the ball will swing outward in an arc, against the force of a spring and the gravitational force acting on the stabilizer, and then will rapidly and smoothly return to the stroking position as a result of the combined forces of gravity and a spring.

A FOURTH EXAMPLE, U.S. Pat. No. 3,934,878 to Haber teaches a tethered ball game adapted for playing in a doorway by one or two players equipped with table tennis paddles. A ball is attached to one end of an elongated suspension member for hanging from the center of a doorway at a convenient height for striking the ball with the paddles. The suspension member has flexible filament upper and lower sections joined by an intermediate inertia member, preferably in the form of a straight stiff wire link heavier than the combined weight of the ball and the upper and lower flexible sections. The inertia member contributes an erratic motion to the ball thereby enhancing the interest of the game.

A FIFTH EXAMPLE, U.S. Pat. No. 3,994,494 to Kelley teaches a batting practice device for baseball batters having a support frame and a generally horizontally disposed laterally extended boom carried by the frame. A flexible cord has a portion thereof mounted to slidably extend along the boom and a portion which depends from the free end of the boom. A ball is connected to the free end of the depending portion of the cord and a motor is connected to the opposite end of the cord for imparting continuous reciprocal movement to the cord longitudinally thereof to vary the length of cord depending from the boom as the ball moves through an arcuate path of travel toward a batter.

A SIXTH EXAMPLE, U.S. Pat. No. 5,681,168 to Brown teaches a tether ball training device that has an adjustable chaotic motion. The invention includes a supporting frame and a non-elastic line suspended from the frame. A resilient ball is mounted at the bottom end portion of the line and a weight slidably attached to the line is positioned in between the lower ball and the upper frame. In a method of training, a player first hits the tethered ball in a first direction of rotation. The ball will undergo chaotic motion as it rotates in this first direction. The player then tries to hit the ball to rotate it in the opposite direction and provide it with a different chaotic motion. This hitting of the ball is repeated. In a method of training a crane operator, a load is placed in motion and a trainee practices bringing the load under control.

It is apparent that numerous innovations for practice devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a practice device for enhancing strike ability of a boxer that avoids the disadvantages of the prior art.

ANOTHER OBJECT of the present invention is to provide a practice device for enhancing strike ability of a boxer that is simple and inexpensive to manufacture.

STILL ANOTHER OBJECT of the present invention is to provide a practice device for enhancing strike ability of a boxer that is simple to use.

BRIEFLY STATED, STILL YET ANOTHER OBJECT of the present invention is to provide a practice device for enhancing strike ability of a boxer that includes a support, a tethered ball suspended from the support, and a deflector operatively connected to the support. The support includes a rigid sheet of material and four flexible lengths of cord nonrestrainingly suspending the sheet of material horizontally from an overhead. The tethered ball is suspended from the sheet of material. The deflector is disposed on one edge of the sheet of material and is wedge-shaped so as to allow the ball to deflect thereoff in a random pattern when stroked by the boxer. The deflector is a equilaterally-triangular-shaped sheet bent acutely, along its altitude, into a pair of panels. Each panel has a slot slid onto one edge of the sheet of material, with the apex of the sheet facing the center of the sheet of material.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures of the drawing are briefly described as follows:

FIG. 1 is a diagrammatic perspective view of the present invention in use;

FIG. 2 is a diagrammatic front elevational view of the area generally enclosed by the dotted curve identified by arrow 2 in FIG. 1 of the present invention;

FIG. 3 is a diagrammatic perspective view of the area generally enclosed by the dotted curve identified by arrow 3 in FIG. 1 of the deflector of the present invention; and FIG. 4 is a diagrammatic bottom plan view taken generally in the direction of arrow 4 in FIG. 3 of the deflector of the present invention shown in FIG. 3 laid out flat.

LIST OF REFERENCE NUMERALS UTILIZED IN THE DRAWING

10 practice device of present invention for enhancing strike ability of boxer 12
12 boxer
14 support
16 tethered ball
18 deflector
20 sheet of material of support 14
22 four corners of sheet of material 20 of support 14
23 four edges of sheet of material 20 of support 14
24 four flexible lengths of cord of support 14 for nonrestrainingly suspending sheet of material 20 of support 14 horizontally from overhead 26
25 center of sheet of material 20 of support 14
26 overhead
27 length of flexible cord of tethered ball 16
28 upper end of length of flexible cord 27 of tethered ball 16
30 lower end of length of flexible cord 27 of tethered ball 16
32 ball of tethered ball 16
34 sheet of deflector 18
35 pair of legs of sheet 34 of deflector 18
36 pair of panels of sheet 34 of deflector 18
37 apex of sheet 34 of deflector 18
38 altitude of sheet 34 of deflector 18
40 slot in each leg of pair of legs 35 of sheet 34 of deflector 18
42 open mouth of slot 40 in each leg of pair of legs 35 of sheet 34 of deflector 18

DESCRIPTION OF THE PREFERRED EMBODIMENT

Referring now to the figures, in which like numerals indicate like parts, and particularly to FIG. 1, the practice device of the present invention is shown generally at 10 for enhancing strike ability of a boxer 12.

The overall configuration of the practice device 10 can best be seen in FIGS. 1 and 2, and as such, will be discussed with reference thereto.

The practice device 10 comprises a support 14, a tethered ball 16 that is suspended from the support 14, and a deflector 18 that is operatively connected to the support 14.

The support 14 comprises a sheet of material 20 that is rigid and rectangular-shaped so as to possess four corners 22, four edges 23, and a center 25.

The support 14 further comprises four flexible lengths of cord 24 that are of equal lengths. Each flexible length of cord 24 is disposed at a respective corner 22 of the sheet of material 2e and is for nonrestrainingly suspending the sheet of material 20 horizontally from an overhead 26.

The tethered ball 16 comprises a length of flexible cord 27 that has an upper end 28 thereof affixed to the center 25 of the sheet of material 20 and a lower end 30 to which a ball 32 is affixed.

The specific configuration of the deflector 18 can best be seen in FIGS. 1–4, and as such, will be discussed with reference thereto.

The deflector 18 is disposed on one edge 23 of the sheet of material 20 and is wedge-shaped so as to allow the ball 32 to deflect thereoff in a random pattern when stroked by the boxer 12.

The deflector 18 comprises a sheet 34 that is rigid and equilaterally-triangular-shaped so as to posses a pair of legs 35 and an apex 37. The sheet 34 is bent acutely, along its altitude 38, into a pair of panels 36 that are each right triangular-shaped.

Each leg 35 of the sheet 34 has a slot 40 that extends longitudinally therealong and has an open mouth 42.

The slot 40 in each leg 35 of the sheet 34 is slid onto the one edge 23 of the sheet of material 20, with the apex 37 facing the center 25 of the sheet of material 20.

It will be understood that each of the elements described above, or two or more together, may also find a useful application in other types of constructions differing from the types described above.

While the invention has been illustrated and described as embodied in a practice device for enhancing strike ability of a boxer, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A Practice device for enhancing strike ability of a boxer, comprising:

a) a support;

b) a tethered hall; and c) a deflectors;

wherein said tethered ball is suspended from said support; and wherein said deflector is operatively connected to said support, wherein said support comprises a sheet of material;

wherein said sheet of material is rigid;

wherein said sheet of material is rectangular-shaped;

wherein said sheet of material possess four corners;

wherein said sheet of material possess four edges; and wherein said sheet of material possess a center, wherein said support comprises four flexible lengths of cord;

wherein said four flexible lengths of cord are of equal lengths;

wherein each flexible length of cord is disposed at a respective corner of said sheet of material; and wherein each flexible length of cord is for nonrestrainingly suspending said sheet of material horizontally from an overhead.

2. The device as defined in claim 1, wherein said tethered ball comprises a length of flexible cord;

wherein said length of flexible cord has an upper end;

wherein said upper end of said length of flexible cord is affixed to said center of said sheet of material;

wherein said length of flexible cord has a lower end; and wherein said lower end of said length of flexible cord has a ball affixed thereto.

3. The device as defined in claim 2, wherein said deflector is disposed on one edge of said sheet of material; and wherein said deflector is wedge-shaped so as to allow said ball to deflect thereoff in a random pattern when stroked by the boxer.

4. The device as defined in claim 1, wherein said deflector comprises a sheet;

wherein said sheet is rigid;

wherein said sheet is equilaterally-triangular-shaped;

wherein said sheet possess a pair of legs; and wherein said sheet possess an apex.

5. The device as defined in claim 4, wherein said sheet is bent acutely, along its altitude, into a pair of panels; and wherein each panel is right triangular-shaped.

6. The device as defined in claim 5, wherein each leg of said sheet has a slot;

wherein said slot extends longitudinally along each leg of said sheet; and wherein said slot in each leg of said sheet has an open mouth.

7. The device as defined in claim 6, wherein said slot in each leg of said sheet is slid onto said one edge of said sheet of material, with said apex facing said center of said sheet of material.

* * * * *